US007866323B2

(12) United States Patent
Catron et al.

(10) Patent No.: US 7,866,323 B2
(45) Date of Patent: Jan. 11, 2011

(54) SMOKING WASTE RECEPTACLE

(75) Inventors: Mark Allen Catron, Winchester, VA (US); Bartholomew James Wellisley, Winchester, VA (US); Steven Robert Jones, Stephens City, VA (US)

(73) Assignee: Rubbermaid Commercial Products LLC, Winchester, VA (US)

( * ) Notice: Subject to any disclaimer, the term of this patent is extended or adjusted under 35 U.S.C. 154(b) by 741 days.

(21) Appl. No.: 11/833,021

(22) Filed: Aug. 2, 2007

(65) Prior Publication Data

US 2008/0029108 A1 Feb. 7, 2008

Related U.S. Application Data

(60) Provisional application No. 60/835,091, filed on Aug. 3, 2006.

(51) Int. Cl.
*A24F 19/00* (2006.01)

(52) U.S. Cl. ..... 131/231; 220/576; 206/496

(58) Field of Classification Search ..... 131/231; 220/576; 206/496
See application file for complete search history.

(56) References Cited

U.S. PATENT DOCUMENTS

| | | | | |
|---|---|---|---|---|
| 399,206 | A * | 3/1889 | Osborn | 19/39 |
| 2,108,436 | A * | 2/1938 | Hardy | 220/576 |
| 5,785,061 | A * | 7/1998 | Whiteley | 131/231 |
| D573,769 | S * | 7/2008 | Skalka | D34/7 |
| 2003/0089722 | A1 | 5/2003 | Luedecke | |
| 2006/0096992 | A1 * | 5/2006 | Weiss et al. | 220/576 |

FOREIGN PATENT DOCUMENTS

| | | | |
|---|---|---|---|
| DE | 700 126 | C | 12/1940 |
| DE | 1 457 598 | A1 | 11/1969 |
| DE | 94 16 258 | U1 | 1/1995 |
| FR | 755 714 | A | 11/1933 |
| GB | 22518 | | 4/1912 |
| GB | 399 026 | A | 9/1933 |
| GB | 962 983 | A | 7/1964 |
| WO | WO 2004/012536 | A1 | 2/2004 |
| WO | WO 2004/110191 | A1 | 12/2004 |

* cited by examiner

*Primary Examiner*—Carlos Lopez
(74) *Attorney, Agent, or Firm*—Foley & Lardner LLP

(57) ABSTRACT

A receptacle for receiving smoking waste includes a canister and a cap disposed on the canister. The cap includes a flow-inhibiting surface for affecting gas flow into the canister and a container member forming a containing area disposed horizontally inward of the flow-inhibiting surface for receiving smoke rising from the collection area. The cap can have at least one snuffing area for snuffing smoking material and at least one depositing area for depositing smoking waste into the canister. The opening for depositing smoking waste can allow for 360 degrees access to the user.

13 Claims, 5 Drawing Sheets

SMOKING WASTE RECEPTACLE

BACKGROUND OF THE INVENTION

The present invention relates to a receptacle for smoking waste, such as cigarette butts or cigar butts. In the United States alone, studies from the American Heart Association have indicated an average of 22% of adults in the United States smoke cigarettes.

Smoking legislation has forced the smoking public to move outdoors from public buildings in several states. Smoking is not permitted within some buildings for other reasons. The building management typically provides only specific designated smoking areas. This results in smoking-waste litter concentrated in a specific area.

It is not desirable to use traditional open-container ashtrays in these areas. Such an ashtray often has a small capacity and fills up quickly with smoking waste, which requires frequent cleaning. The cigarette butts are left exposed, creating an unsightly condition, odor, and a possible hazard because the cigarette butts are not completely extinguished. Also the traditional ashtray typically includes rest notches, which encourage a smoker to set a smoldering cigarette on the ashtray, thereby creating second hand smoke.

Manufacturers have introduced smoking stations or receptacles for use in these designated smoking areas. Conventional smoking receptacles are often designed to contain the smoking waste within the receptacle and are generally large, sometimes having heights of 36 inches or taller. The smoking waste typically enters the receptacle through a small hole at the top and travels through a long neck until falling into a collection container at the bottom. Conventional smoking receptacles have several drawbacks.

First, some conventional receptacles suffer from an undesirable amount of smoldering of deposited cigarettes. Smoldering is undesirable because it results in second hand smoke and can cause fires. A conventional receptacle may provide sand in the collection container for the purpose of causing deposited cigarettes to extinguish themselves in the sand. After a sufficient number of cigarettes are deposited, however, the sand becomes covered and is rendered useless. Moreover, the user must sift through the dirty sand/butt mixture to empty the collection container. Another conventional receptacle includes baffles within the neck to reduce the amount of oxygen inside the receptacle, for the purpose of shortening the amount of time a cigarette can smolder. However, trash or cigarettes deposited in the receptacle may rest on the baffles and clog the neck inside of the receptacle.

Second, fires may occur within conventional smoking receptacles if flammable trash is deposited in them. For example, a conventional receptacle may make it easy to force trash, such as gum wrappers or paper, through the receptacle opening and into the cigarette butt storage area. This build up of trash makes it easier for fires to start inside the receptacles. The fires started may burn inside of the receptacles. Some plastic receptacles have melted as a result of an internal fire. Receptacle manufacturers have, therefore, limited the size of the cigarette deposit opening (to inhibit the insertion of trash) in conjunction with filling the collection container inside the receptacle with sand (to extinguish fires). If the cigarettes cover the sand, however, the sand may not extinguish the smoldering butts and prevent fire. Receptacles with baffles also can experience problems preventing fires. The baffles can clog with trash, which enables the smoldering cigarette butts to start fires originating at the baffles.

Third, some conventional smoking receptacles also make it harder for the user to access the receptacles. Conventional receptacles provide limited areas for the user to deposit their cigarette or cigar butts. It is easy for users to miss these areas when they deposit their butts. The limited access makes it more likely to find cigarette and cigar butt waste on the ground rather than inside of the receptacles.

Fourth, it is relatively easy to steal parts of conventional smoking receptacles. A common way to protect a receptacle from thieves is to thread a bolt through the components of the receptacle. Other receptacles have keyed locking mechanisms. Too many thieves, however, are still able to abscond with receptacle parts.

SUMMARY OF THE INVENTION

One embodiment of the invention relates to a receptacle for smoking waste, comprising a canister and a cap. The canister receives smoking waste in a collection area. A cap is disposed on the canister. The cap includes a flow-inhibiting surface for affecting gas flow into the canister and a container member forming a containing area disposed horizontally inward of the flow-inhibiting surface for receiving smoke rising from the collection area.

Another embodiment of the invention relates to a receptacle for smoking waste comprising a canister and a cap. The canister receives receiving smoking waste. A cap is disposed on the canister. The canister has at least one snuffing area for snuffing smoking material and at least one depositing area for depositing smoking waste into the canister. The snuffing and depositing areas extend over substantially an entire periphery of the receptacle within a horizontal plane.

According to one embodiment of the invention, the receptacle for smoking waste, comprises a canister for receiving smoking waste in a collection area. The canister includes an outer shell and an inner lining fixed inside the outer shell and forming the collection area. The inner lining is connected to outer shell so as to leave a gap between the inner lining and the outer shell. A cap is disposed on the canister.

According to another embodiment of the invention, a method of emptying a smoking-waste receptacle into a container. The smoking-waste receptacle includes a cap disposed on top of a canister that is disposed on top of a base. The method comprises removing the cap from the canister, removing the canister from the base, and manipulating the canister to deposit smoking waste from the canister into a container.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate embodiments of the invention and, together with the description, serve to explain the principles of the invention.

DETAILED DESCRIPTION OF THE PREFERRED EMBODIMENTS

Figure 1:
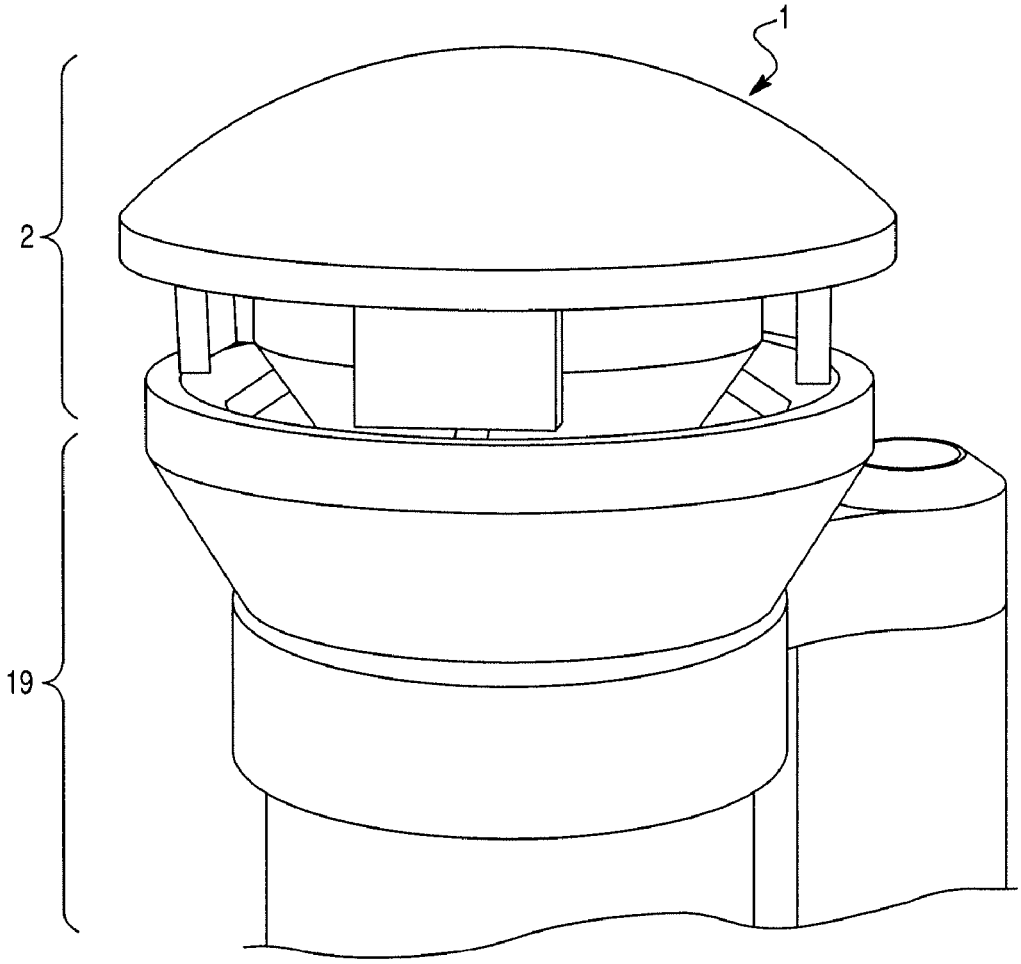
FIG. 1 is a top partial perspective view of a receptacle according to a first embodiment of the present invention.
Figure 2:
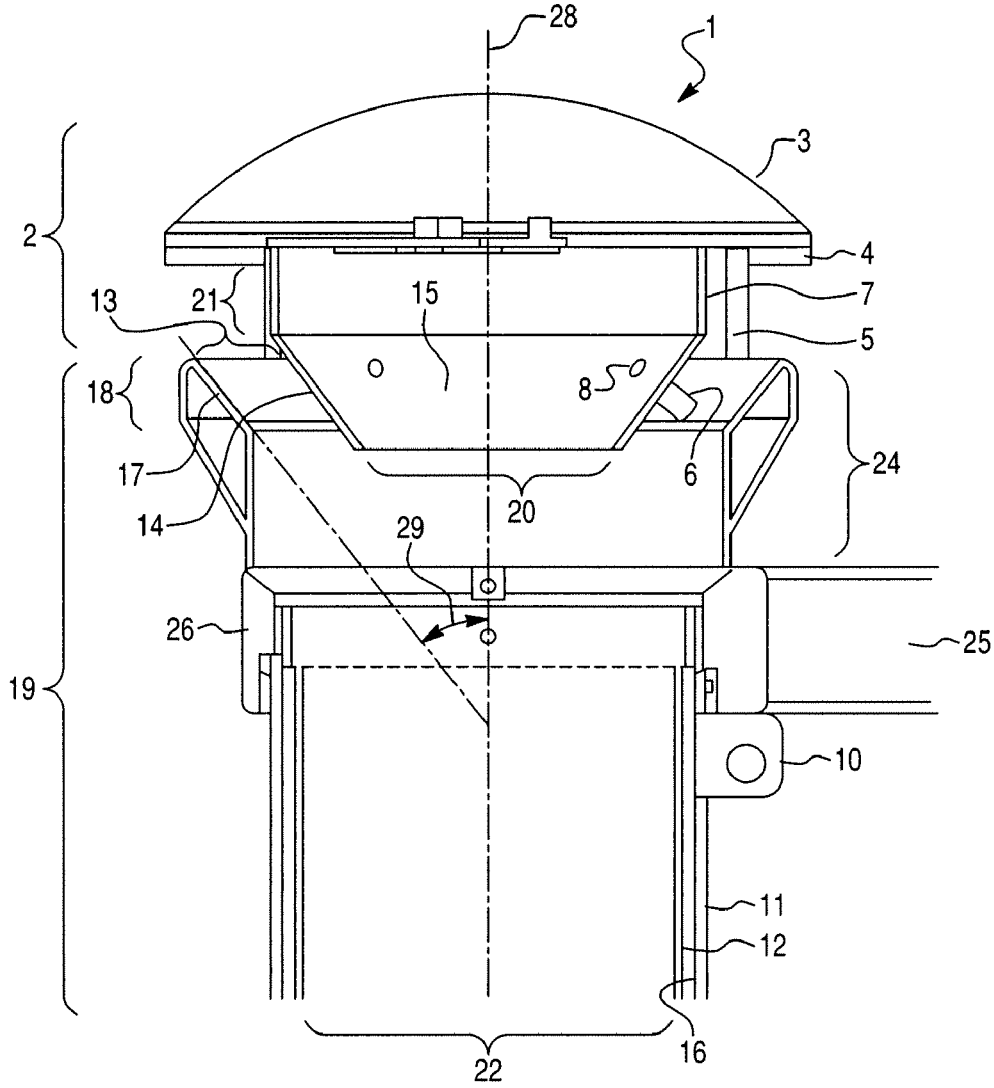
FIG. 2 is a cross-sectional view of the receptacle of FIG. 1.
Figure 3:
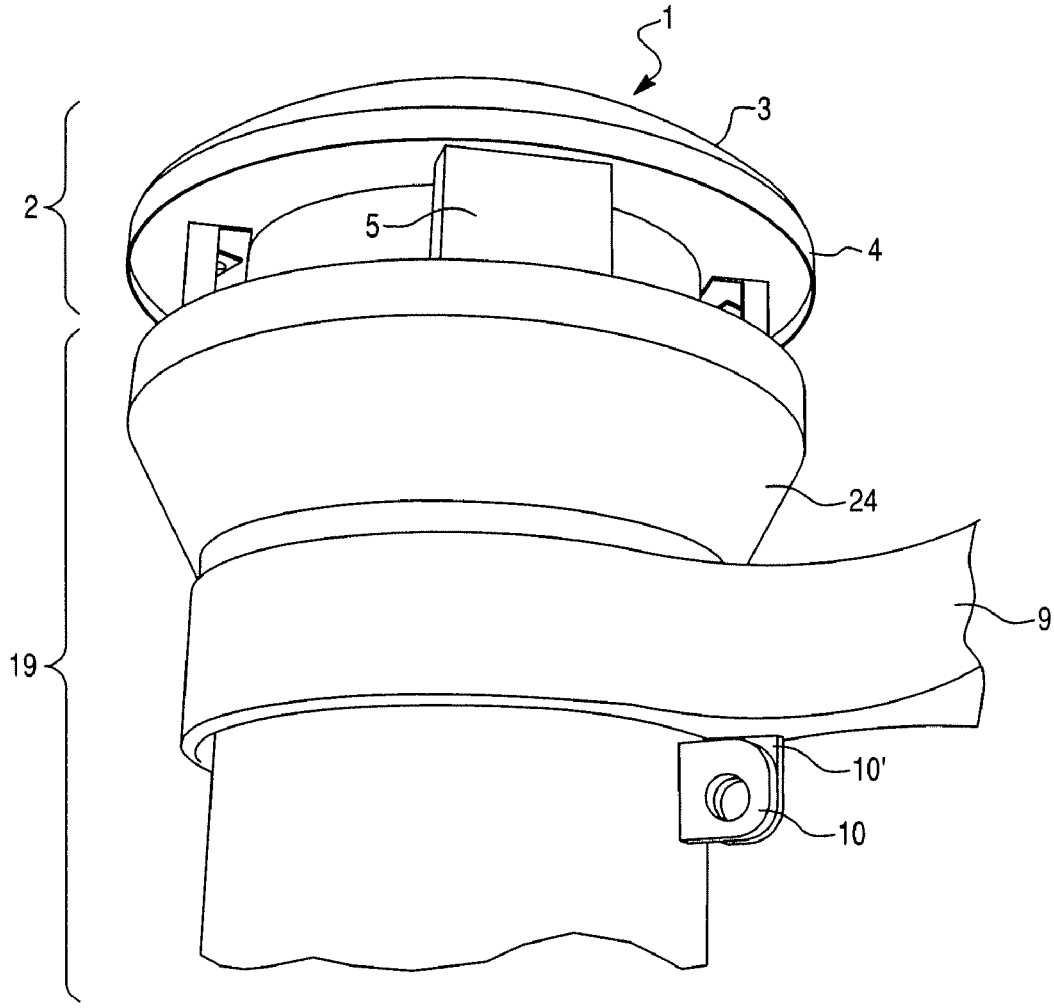
FIG. 3 is a bottom, partial perspective view the receptacle of FIG. 1.

Reference will now be made in detail to preferred embodiments of the invention, examples of which are illustrated in the accompanying drawings. An effort has been made to use the same reference numbers throughout the drawings to refer to the same or like parts.

According to a first embodiment of the invention, shown in FIGS. 1, 2, 3, 4, and 5, a receptacle 1 has a canister 19 and a cap 2. The receptacle 1 preferably receives smoking waste. While the term smoking waste is intended to broadly mean any waste associated with smoking, preferably only cigarette or cigar butts are deposited within the receptacle 1.

The canister 19 can be configured to receive and hold smoking waste. Though the canister 19 preferably has a tubular configuration, it can be formed in any usable shape. Preferably the canister 19 includes a collection area 22 for holding the smoking waste and a guiding surface 17 that is configured to guide smoking waste into the collection area 22.

The canister 19 can be any structure that will receive and hold the smoking waste. Preferably it includes, at a lower end, an outer shell 11 and an inner lining 12. The outer shell 11 and the inner lining 12 are each preferably substantially tubular members that are disposed within one another and substantially share the same centerline 28. Preferably the diameter of the inner lining 12 is smaller than the diameter of the outer shell 11. Consequently, in the cross-sectional view shown in FIG. 2, a wall of the inner lining 12 and a wall of the outer shell 11 extend substantially parallel to one another with a gap 16 there between. This gap 16 can provide insulation to inhibit the transfer of heat from the collection area 22 to the outer shell 11, which may be touched by users. Preferably the inner lining 12 is formed of metal, and the outer shell 11 is formed of metal or heat-resistant plastic.

The guiding surface 17 can be configured to guide smoking waste inserted into the receptacle 1 into the collection area 22 of the canister 19. Preferably, the guiding surface 17 slopes downward toward the centerline 28 of the canister 19 to guide the smoking waste toward the center of the canister 19. The angle 29 of the guiding surface 17 relative to the centerline 28 of the canister 19 is preferably within the range of approximately 35° to 45°.

Figure 4:
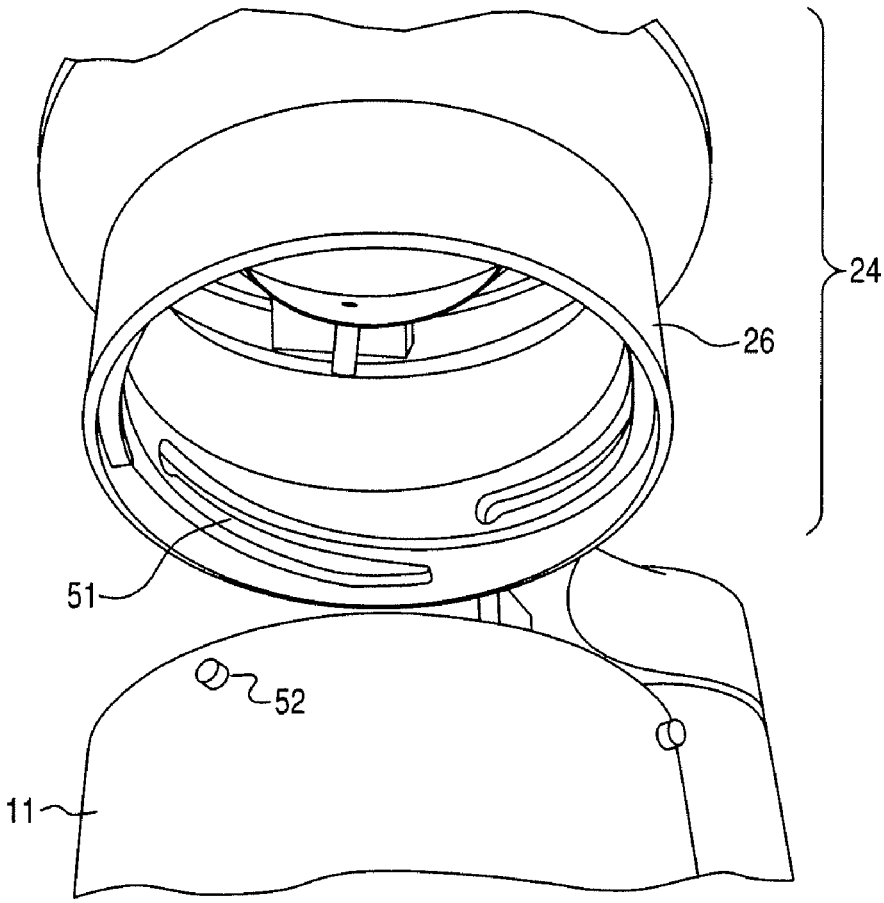
FIG. 4 is a bottom, partial, exploded perspective view of the receptacle of FIG. 1.

The guiding surface 17 may be provided on a rim portion 24 of the canister 19. The rim portion 24 can be formed, for example of a material such as metal or heat-resistant plastic. Preferably, the rim portion 24 has a collar 26 that is configured to be affixed to the upper portion of the outer shell 11 and to hold the inner lining 12 in position within the outer shell 11. As shown in FIG. 4, slots 51 on the collar 26 can receive pins 52 projecting from the upper portion of the outer shell 11 to connect the collar 26 to the outer shell 11. The slots 51 and pins 52 can be configured such that the outer shell 11 can be removed from the collar 26 by executing a quarter turn of the outer shell 11 relative to the collar 26.

Figure 5:
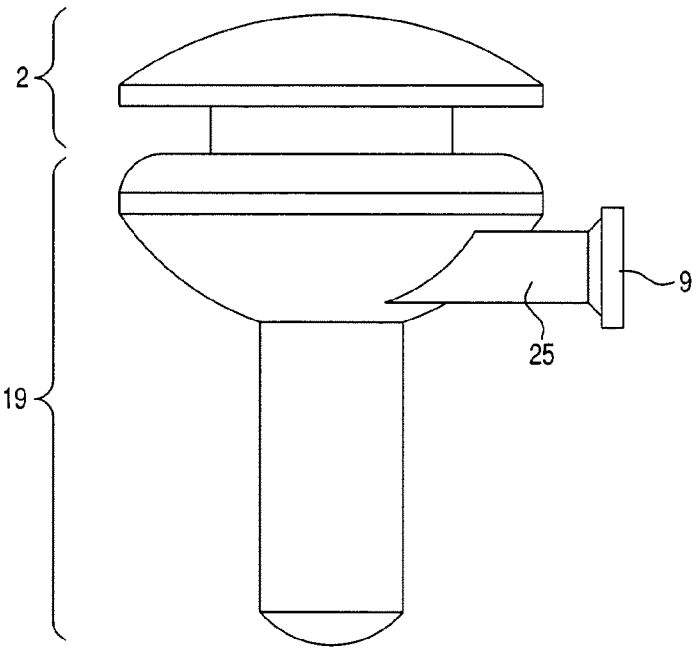
FIG. 5 is a front view of the receptacle of FIG. 1.

The canister 19 may also have two tabs for a lock. One tab 10 is located on the outer shell 11 and the other tab 10' is located on a support bracket 25 extending outward from the collar 26. The two tabs 10 and 10' align when the outer shell 11 is rotated into an affixed position relative to the collar 26. The user can place, for example, a padlock through the two tabs 10 and 10' to secure the outer shell 11 to the support bracket 25 to prevent theft or vandalism. In this embodiment, as shown in FIG. 5, the support bracket 25 can extend and connect with a mount 9 that is attachable to, for example, a wall or other apparatus.

The cap 2 can be configured to cover the collection area 22 and to inhibit the flow of gases into and out of the collection area 22. The cap 2 can include a flow-inhibiting surface 14 and a container member 15.

The flow-inhibiting surface 14 preferably inhibits the flow of gases, such as air and smoke, into and out of the canister 19. The flow-inhibiting surface 14 preferably slopes downward and is substantially parallel to the guiding surface 17, with a preferred spacing of approximately three quarters of an inch. The flow-inhibiting surface 14 can be formed, for example, of sheet metal.

The flow-inhibiting surface 14 and the guiding surface 17 can form a funnel area 18. The funnel area 18 preferably has a substantially circular cross section, which reduces flat surfaces that might be contacted by the wind. Therefore, wind tends to pass around the funnel area 18 rather than catching on a flat surface and diverting into the canister 19. The funnel area 18 can be configured to allow a cigarette or cigar butt to pass, but to prevent the majority of smoke from escaping the canister 19. Preferably smoke from the smoking waste will swirl around within the canister 19 under the flow-inhibiting surface 14 and will be inhibited from escaping through the cap 2. The smoke circulating within the canister 19 may also restrict oxygen flow to the smoking waste in the canister 19.

The flow-inhibiting surface 14 and the guiding surface 17 also can form a slot opening 13 that is configured to receive smoking waste. Smoking waste entering the slot opening 13 empties into the funnel area 18. The slot opening 13 is disposed inside the receptacle 1. This placement of the slot opening 13 can reduce the amount of wind that can blow into the containing area 20 (described below), which can reduce smoldering time and the amount of smoke that can billow back up and out of the receptacle 1.

The slot opening 13 can be disposed around the entire periphery of the receptacle 1 within a horizontal plane to form a depositing area 21 that allows 360 degrees access to users, instead of the one or two small deposit holes of a conventional smoking receptacle. Such a depositing area 21 is more accessible and does not require as much aim from the user to deposit a butt. This reduces the number of butts that fall on the ground as a result of the user trying to deposit the butt but instead missing the one of two small deposit holes of a conventional smoking receptacle.

The container member 15 of the cap 2 forms a containing area 20. The container member 15 can be bounded, in part, by the flow-inhibiting surface 14. The containing area 20 of the container member 15 can be configured to receive smoke rising from the canister 19.

The cap 2 also can include a cover member 3. The cover member 3 preferably extends horizontally outward from the slot opening 13 and covers the width of the canister 19 below. The cover member 3 can be configured to inhibit smoke from exiting the receptacle 1 and to inhibit air from entering the receptacle 1. The cover member 3 can be, for example, formed from sheet metal.

Preferably, the cap 2 includes a snuffing area 7. The snuffing area 7 allows a user to snuff smoking materials, for example, cigarette and cigar butts before placing the smoking materials into the canister 19. The snuffing area 7 can be an arced surface extending over substantially the entire periphery of the receptacle 1 in a horizontal plane. This allows for greater user access to the receptacle 1 than conventional smoking receptacles. In particular, the snuffing area 7 can be configured to allow 360 degree access by users, instead of a limited snuffing area. In addition, the surface of the snuffing area 7 can also serve as a flow-inhibiting surface, that preferably works in conjunction with flow-inhibiting surface 14.

The cap 2 can be mounted on the canister 19 by a plurality of supports 5 and a plurality of rods 6. The supports 5 can be of uniform height and disposed between the cover member 3 and the canister 19. The rods 6 can also be of uniform height and disposed between the flow-inhibiting surface 14 and the guiding surface 17. The supports 5 and rods 6 can be attached by rivets or other conventional means. The rods 6 help maintain an appropriate space between the flow-inhibiting surface 14 and the guiding surface 17.

Figure 6:
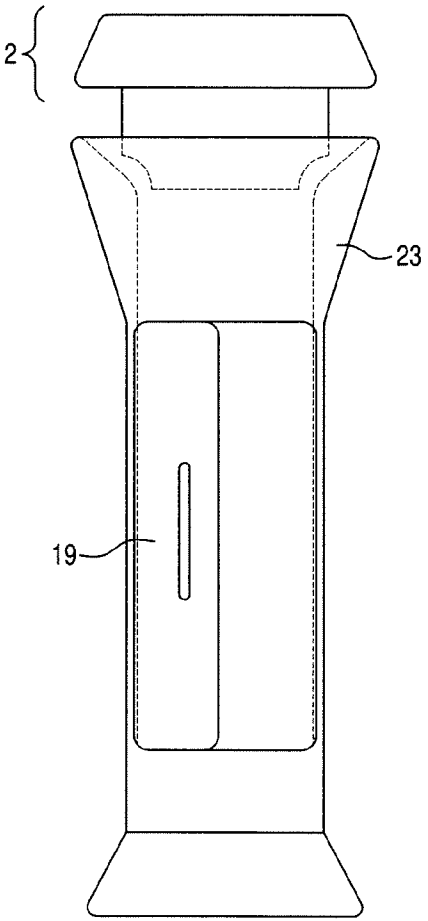
FIG. 6. is a side view of a receptacle according to a second embodiment of the present invention.

FIG. 6 shows a second embodiment of the present invention. In this embodiment, the smoking receptacle 1 does not have a mount 9. Instead, at least a portion of the canister 19 is disposed within a base 23. Preferably this embodiment is not stationary and the user can place the smoking receptacle 1 in a wider range of environments. The base 23 may house the canister 19. The base 23 can be formed, for example, of material such as metal or plastic.

A method for emptying a smoking-waste receptacle 1 into a container according to the present invention will now be described. The receptacle 1 includes a cap 2, a canister 19, and a base 23.

Preferably, the cap 2 is connected to the base 23 by conventional means that allow a user to remove the cap 2 from the canister 19 and the canister 19 from the base 23. For example, the cap 2 and base 23 can be loosely connected by fitting the container member 15 of the cap 2 within the rim 24 of the base 23 such that the center portion of the container member 15 rests on the rim 24 of the base 23. More secure connections, such as interference, threaded screws, or friction fits, could also be provided. To remove the cap 2 from the canister 19 one can unscrew the cap 2 from the canister 19. The canister 19 can screw onto the base 23 and to remove the canister 19 from the base 23 one can unscrew the canister 19 from the base 23. One can lift the canister 19 to deposit the smoking waste from the canister 19 into a container.

The embodiments described above have been set forth herein for the purpose of illustration. This description, however, should not be deemed to be a limitation on the scope of the invention. Various modifications, adaptations, and alternatives may occur to one skilled in the art without departing from the claimed inventive concept. The scope and spirit of the invention are indicated by the following claims.

What is claimed is:

1. A receptacle for smoking waste, the receptacle comprising:

a canister for receiving smoking waste in a collection area; and a cap disposed on the canister, the cap including a flow-inhibiting surface for affecting gas flow into the canister and a container member forming a containing area disposed horizontally inward of the flow-inhibiting surface for receiving smoke rising from the collection area, wherein the canister includes a guiding surface for guiding smoking waste into the canister, and the guiding surface slopes downwardly toward a center of the canister.

2. The receptacle of claim 1, wherein the guiding surface and the flow-inhibiting surface form an opening through which smoking waste can be deposited into the canister.

3. The receptacle of claim 2, wherein the cap includes a cover member that extends horizontally outward of the opening.

4. A receptacle for smoking waste, the receptacle comprising:

a canister for receiving smoking waste; and a cap disposed on the canister and having at least one snuffing area for snuffing smoking material, at least one depositing area for depositing smoking waste into the canister, and a cover member, wherein the cap is mounted on the canister by a plurality of supports that abut both the cover member of the cap and a surface of the canister such that the snuffing and depositing areas extend over substantially an entire periphery of the receptacle within a horizontal plane.

5. The receptacle of claim 4, wherein the snuffing area extends over substantially the entire periphery of the receptacle within the horizontal plane.

6. The receptacle of claim 4, wherein the depositing area extends over substantially the entire periphery of the receptacle within the horizontal plane.

7. The receptacle of claim 1, wherein the canister includes an outer shell and an inner lining fixed inside the outer shell and forming the collection area, and wherein the inner lining is connected to outer shell so as to leave a gap between the inner lining and the outer shell.

8. The receptacle of claim 7, further comprising a rim affixed to an upper portion of the outer shell to hold the inner lining within the outer shell.

9. A receptacle for smoking waste, the receptacle comprising:

a canister for receiving smoking waste; and a cap disposed on the canister and having at least one snuffing area for snuffing smoking material and at least one depositing area for depositing smoking waste into the canister, wherein the snuffing and depositing areas extend over substantially an entire periphery of the receptacle within a horizontal plane, and wherein the canister includes a guiding surface for guiding smoking waste into the canister, and the guiding surface slopes downwardly toward a center of the canister.

10. The receptacle of claim 9, wherein the snuffing area extends over substantially the entire periphery of the receptacle within the horizontal plane.

11. The receptacle of claim 9, wherein the depositing area extends over substantially the entire periphery of the receptacle within the horizontal plane.

12. The receptacle of claim 9, wherein the canister includes an outer shell and an inner lining fixed inside the outer shell and forming a collection area, and wherein the inner lining is connected to outer shell so as to leave a gap between the inner lining and the outer shell.

13. The receptacle of claim 12, further comprising a rim affixed to an upper portion of the outer shell to hold the inner lining within the outer shell.

* * * * *